United States Patent [19]

Gonzalez et al.

[11] Patent Number: 5,042,594

[45] Date of Patent: Aug. 27, 1991

[54] APPARATUS FOR ARMING, TESTING, AND SEQUENTIALLY FIRING A PLURALITY OF PERFORATION APPARATUS

[75] Inventors: Manuel T. Gonzalez, Sugar Land; Clifford L. Aseltine, Houston; Terrell E. Dailey, Bellaire; Charlie S. Stulb, League City, all of Tex.

[73] Assignee: Schlumberger Technology Corporation, Houston, Tex.

[21] Appl. No.: 530,032

[22] Filed: May 29, 1990

[51] Int. Cl.[5] ..... E21B 43/116

[52] U.S. Cl. ..... 175/4.55; 89/1.15

[58] Field of Search ..... 89/1.15; 175/4.55, 4.6

[56] References Cited

U.S. PATENT DOCUMENTS

| | | | |
|---|---|---|---|
| 3,116,689 | 1/1964 | Sumner | 175/4.55 |
| 3,246,707 | 4/1966 | Bell | 175/4.55 |
| 3,246,708 | 4/1966 | Harrigan et al. | 175/4.55 |
| 3,327,791 | 6/1967 | Harrigan, Jr. | 175/4.55 |
| 3,380,540 | 4/1968 | Fields | 175/4.55 |
| 3,773,120 | 11/1973 | Stroud et al. | 175/4.55 |
| 3,776,323 | 12/1973 | Spidell | 175/4.55 |
| 4,051,907 | 10/1977 | Estes | 175/4.55 |
| 4,208,966 | 6/1980 | Hart | 175/4.55 |
| 4,496,010 | 1/1985 | Chapman, III | 175/4.55 |
| 4,527,636 | 7/1985 | Bordon | 175/4.55 |

OTHER PUBLICATIONS

"Electronic and Small Dimension Fuses" catalog by Cooper Industries Jan., 1989.

*Primary Examiner*—David H. Brown

*Attorney, Agent, or Firm*—Henry N. Garrana; John H. Bouchard

[57] ABSTRACT

A perforating gun apparatus comprises a plurality of perforating gun, each gun containing at least one charge and a novel arming, testing and firing apparatus. The arming, testing and firing apparatus arms a first charge in a lowermost perforating gun; however, the arming of the first charge in the lowermost perforating gun allows a tester disposed at the well surface to determine the identity of the lowermost perforating gun to be detonated. Furthermore, the arming of the first charge in the lowermost perforating gun also enables the arming of a second charge in an adjacent perforating gun of the gun string. In the event the first charge is not armed as expected, the arming, testing and firing apparatus in the lowermost perforating gun bypasses the lowermost perforating gun and begins to arm the second charge in the adjacent perforating gun of the gun string. A novel housing for a perforating gun includes an isolated chamber in which a charge is mounted, the chamber having two opposite walls, one wall being circumferentially rotatable and including a radially disposed detonator. Since a detonating cord is longitudinally disposed in the chamber, the circumferentially rotatable characteristic of the one wall in association with the radial disposition of the detonator provides a safe arm feature of the perforating gun.

20 Claims, 4 Drawing Sheets

APPARATUS FOR ARMING, TESTING, AND SEQUENTIALLY FIRING A PLURALITY OF PERFORATION APPARATUS

BACKGROUND OF THE INVENTION

The subject matter of the present invention relates to perforating apparatus, and more particularly, to an apparatus for arming, testing and sequentially firing a plurality of perforating apparatus.

A perforating apparatus includes a plurality of charges, each of which will successively detonate when a detonation wave propagates along a detonating cord connected to the charge. The detonation wave originates from a booster which is adapted to receive an electrical current signal from an electrical conductor and which generates the detonation wave for propagation along the detonating cord. The electrical current signal is sometimes received by the booster when a switch closes thereby allowing the electrical correct to energize the booster. For example, U.S. Pat. No. 4,208,966 to Hart discloses a perforating system whereby a switch, when actuated, allows the electrical current signal to energize a booster for detonating one of the plurality of charges; however, the actuation of the switch also actuates another switch which successively drops one of a plurality of zener diodes from a circuit. In Hart, as the zener diodes successively drop out of the circuit in synchronism with the detonation of the plurality of charges, the identity of each detonated charge may be identified by the voltage present in the series connected zener diode circuit. However, in Hart, the actuation of the first aforementioned switch for detonating a first charge of the plurality of charges fails to enable the subsequent actuation of the switch in the perforating system, or the subsequent actuation of another switch in another perforating system, for detonating a second charge of the plurality; furthermore, no provision is made for taking appropriate compensatory action when the first aforementioned switch fails to actuate and thereby detonate the first charge of the plurality of charges. Finally, no provision is made for housing the system of Hart in a manner which provides a safe-arm feature.

SUMMARY OF THE INVENTION

Accordingly, it is a primary object of the present invention to provide an arming, testing and firing system for use in a perforating apparatus, the system performing at least three functions in response to a movement of a switch from one position to another position, namely, arming at least one charge in the perforating apparatus; allowing a tester disposed at the well surface to determine the identity of the one charge in the perforating apparatus to be detonated; and enabling the movement of a further switch, associated with another charge in another perforating apparatus, from one position to another position thereby enabling the arming of said another charge in said another perforating apparatus and allowing the tester to determine the identity of the other charge in the other perforating apparatus.

It is a further object of the present invention to provide a bypass circuit associated with a switch corresponding to each charge of the plurality of charges, the bypass circuit bypassing the switch and the charge in the event the switch fails to move from the one position to the other position and fails to arm the charge.

It is a further object of the present invention to provide a new housing for the novel arming, testing and firing system of a perforating apparatus, the new housing including two intermediate heads, each head being adapted to be inserted into an outer carrier housing of the perforating apparatus, the two intermediate heads disposed within the outer carrier housing defining an isolated chamber within the carrier housing for containing a charge associated with the perforating apparatus, the chamber including two metal walls disposed on opposite sides for providing the isolation, each wall being associated with an intermediate head, one wall being circumferentially rotatable and further including a radially disposed detonator for detonating the charge disposed in the isolated chamber, the circumferentially rotatable characteristic of the one wall providing a safe-arm advantage, since the detonator cannot detonate the charge in the chamber when the one wall in which the detonator is disposed is rotated out of circumferential alignment with respect to a detonating cord of the charge.

In accordance with these and other objects of the present invention, a perforating apparatus contains at least one charge. A switch is associated with the charge in the perforating apparatus. A fuse is associated with the switch, the fuse having a moveable arm which is moveable from a retracted position to an extended position when a current of predetermined magnitude passes through the fuse. When the current of predetermined magnitude passes through a fuse associated with the lowermost perforating apparatus, the arm of the fuse moves to its extended position thereby moving the switch, associated with the fuse, from one position to another position. Movement of the switch from the one position to the other position drops a zener diode out of the circuit, the zener being present when the switch was in the one position, the zener being absent when the switch is in the other position. Absence of the zener in the resultant circuit reduces the overall voltage drop in the circuit by an amount equal to the voltage drop across the zener. The resultant voltage drop along the circuit identifies the specific charge or the specific perforating apparatus being detonated. Since the switch has moved to the new, other position, the charge or the perforating apparatus associated with that switch is armed and ready to fire when a current of sufficient magnitude and correct polarity energizes the charge or gun via the switch. When the charge or gun detonates, since the switch has already moved from the one position to the other position, the arming of another charge in another perforating apparatus has been enabled; that is, another new current of sufficient magnitude and polarity passes through the switch, currently located in the other position, and energizes another fuse associated with another charge or perforating apparatus adjacent to the lowermost perforating apparatus. The arm associated with the other fuse extends thereby moving a further second switch from one position to another position. The charge or perforating apparatus adjacent the lowermost perforating apparatus is armed; but, when the further second switch moves to the other position, another second zener diode drops out of the overall circuit, further reducing the voltage drop along the circuit. The new reduced voltage drop identifies the charge/perforating apparatus adjacent the lowermost perforating apparatus to be detonated. Another current of sufficient magnitude and polarity fires the charge/-perforating apparatus adjacent the lowermost perforating apparatus. The entire process as above described continues until all perforating apparatus in the gun string are detonated. If a particular switch fails to move from one position to another position in response to the passage of sufficient current through its associated fuse, a bypass circuit connected across the particular switch bypasses the switch and therefore bypasses the charge or perforating apparatus associated with that switch. In that event, an adjacent fuse disposed adjacent the particular switch will receive the current intended for the fuse associated with the particular switch. In addition, a novel housing for containing the novel arming, testing and firing system of the present invention includes an isolated chamber having one circumferentially rotatable wall in which a detonator is radially disposed, the radial disposition of the detonator in combination with the circumferentially rotatable characteristic of the one wall providing a safe-arm system associated with the new perforating apparatus.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
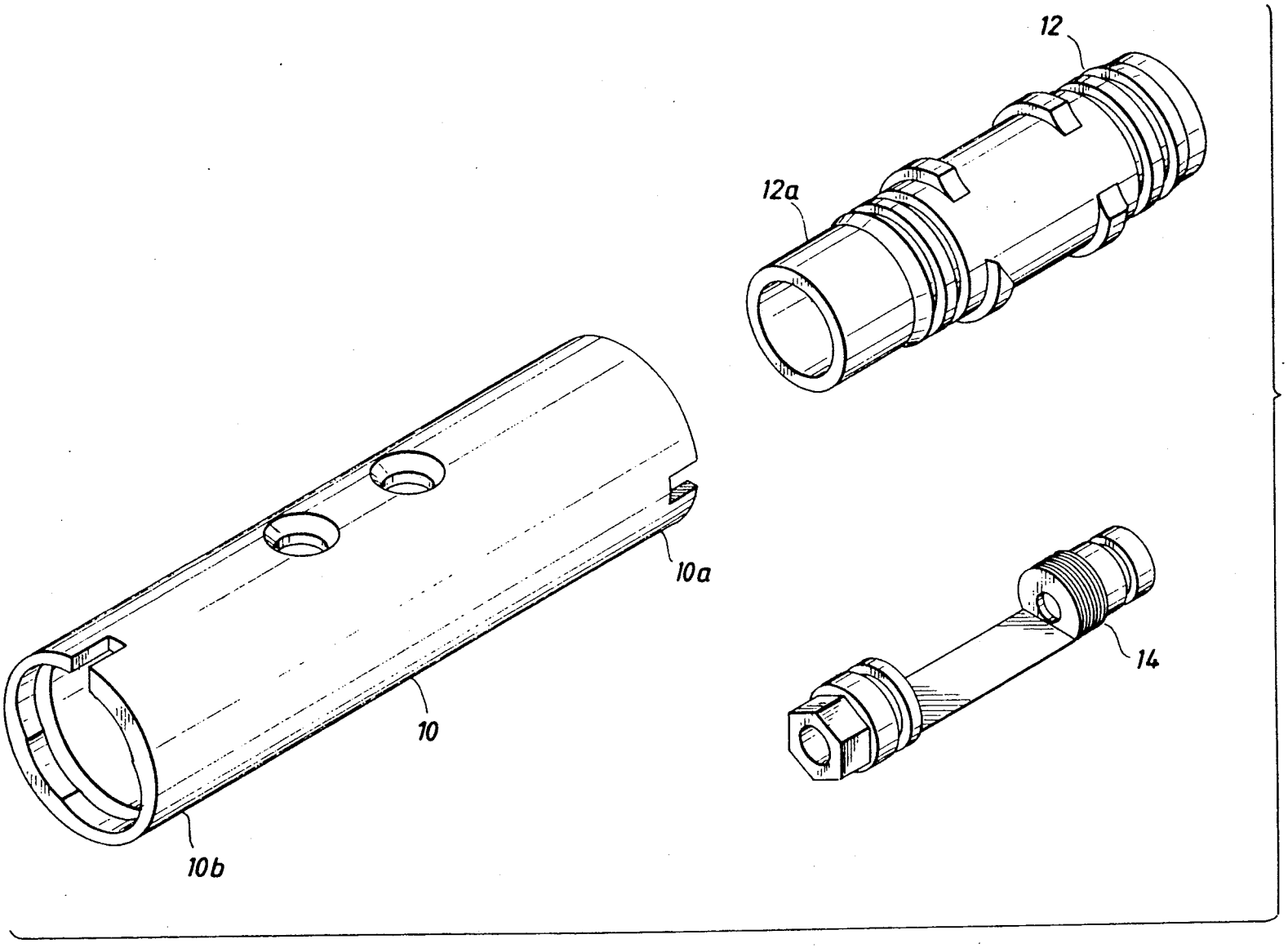
FIG. 1 illustrates a three dimensional view of the novel housing associated with a perforating apparatus, which housing encloses the novel arming, testing and firing system of the present invention.

Referring to FIG. 1, the novel housing of a perforating apparatus, in accordance with one aspect of the present invention, is illustrated, the housing enclosing the novel arming, testing and firing system of such perforating apparatus, in accordance with another aspect of the present invention.

In FIG. 1, the novel housing of a perforating apparatus, in accordance with one aspect of the present invention, includes a single shot carrier 10, an intermediate head 12, and a switch housing 14. The switch housing 14 fits within the intermediate 12, and an end 12*a* of intermediate head 12 fits within an end 10*a* of the single shot carrier 10. Another intermediate head containing another switch housing (not shown in the drawings) fits within the other end 10*b* of the carrier 10. As a result, a plurality of carriers 10, each including a shape charge perforating apparatus, may be serially fit together as a string of perforating guns, the string of perforating guns being adapted to be disposed in a borehole. This serial construction of perforating guns will be more readily understood with reference to FIG. 2.

Figure 2:
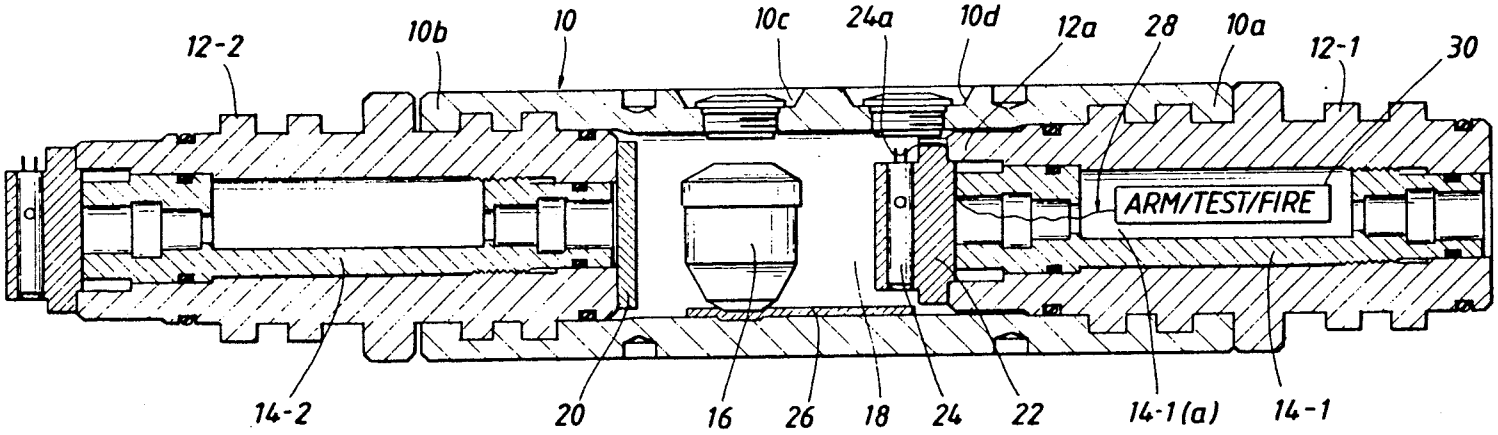
FIG. 2 illustrates a longitudinally disposed cross sectional view of the housing of FIG. 1 containing the perforating apparatus and the arming, testing and firing system of such perforating apparatus.

Referring to FIG. 2, a longitudinally disposed cross sectional view of the novel housing of FIG. 1 containing the shape charge perforating apparatus and the novel arming, testing and firing system of the perforating apparatus is illustrated.

In FIG. 2, one end of a first intermediate head 12-1 fits within one end of the carrier 10, and one end of a first switch housing 14-1 fits within the first intermediate head 12-1. The other end of a second intermediate head 12-2 fits within the other end of carrier 10, and the other end of a second switch housing 14-2 fits within the second intermediate head 12-2, as shown in FIG. 2. The one end of the second intermediate head 12-2 is now adapted to be fit within another carrier (not shown in the drawings). A shape charge 16 is disposed directly adjacent a first window 10*c* in carrier 10 and within an isolated chamber 18 within the carrier 10, the chamber 18 being isolated because it is bounded by a first wall 20, a second wall 22, and the carrier 10. A second window 10*d* in carrier 10 is not used in the FIG. 2 embodiment (although it can be used to arm-through), but it is present in carrier housing 10 in the event it is ever needed for windowing an adjacent shape charge. The first wall 20 is physically a part of a loading tube (to be described with reference to FIG. 2*a*) and is held in place against the other end of the second intermediate head 12-2. The second wall 22 is connected to the one end of the first intermediate head 12-1. The second wall 22 is circumferentially rotatable with the first intermediate head 12-1 and further includes a radially disposed cavity in which a detonator 24 is inserted. Electrical wires 28 are connected (via a feedthru to be described with reference to FIG. 2*a*), on one end, to terminals 24*a* of detonator 24 and, on the other end, to an arming, testing and firing circuit 30 present within an internal space 14-1(*a*) of the first switch housing 14-1. A detonating cord 26 is connected, on one end, to the shape charge 16, and is adapted to be disposed adjacent to the detonator 24 on the other end. Since the second wall 22 is circumferentially rotatable with the first intermediate head 12-1, the detonator 24 in the radially disposed cavity of the second wall 22 is also circumferentially rotatable with respect to the detonating cord 26. When the detonator 24 is rotated out of alignment with respect to the detonating cord 26, it cannot ignite the detonating cord 26 in the event the detonator 24 fires accidentally. Thus, the circumferentially rotatable detonator 24 represents a safe-arm feature associated with the novel housing of FIG. 2. Since the first and second intermediate heads 12-1 and 12-2 are fit within the carrier 10 which contains a shape charge 16, and each head 12-1 and 12-2 is adapted to contain a switch housing 14-1 and 14-2 and an arming, testing and firing circuit 30 for ultimately firing the charge 16, a plurality of carriers 10, containing a plurality of shape charges 16, may be serially fit together to form a gun string, the gun string comprising a plurality of perforating guns.

Figure 2A:
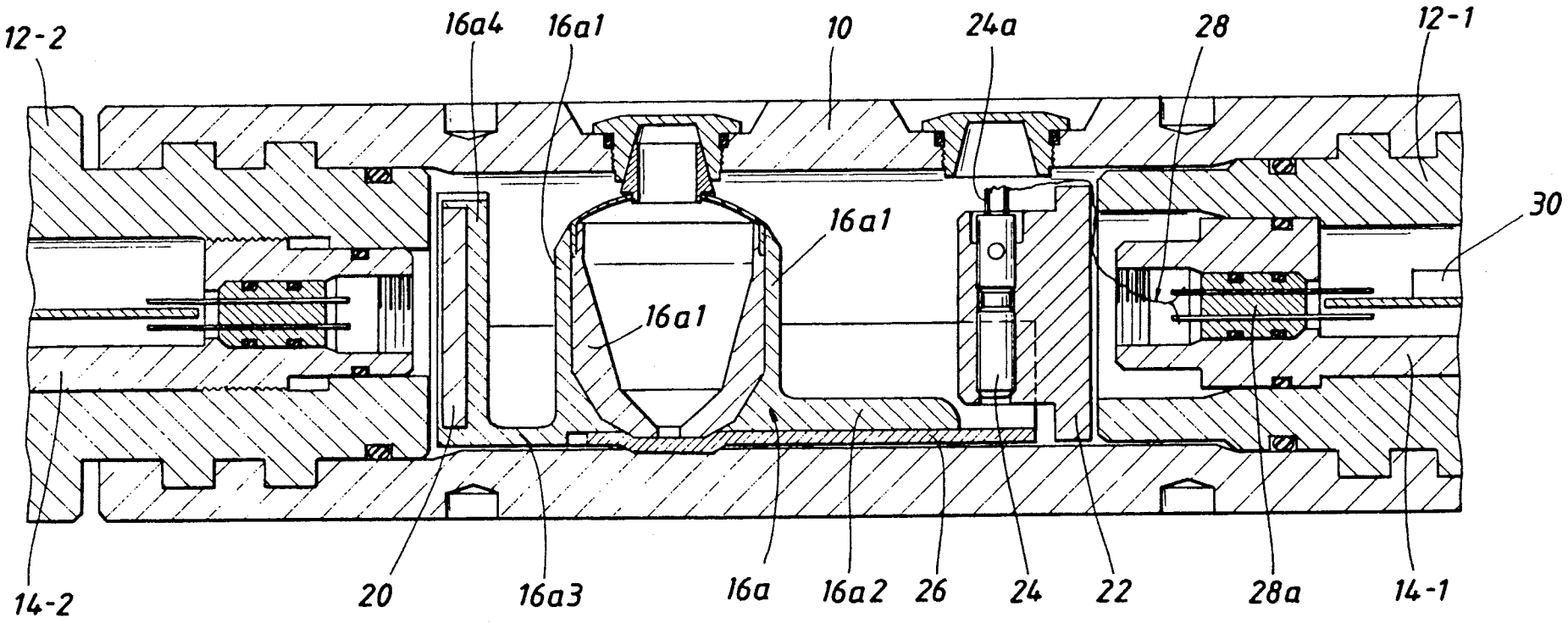
FIG. 2*a* illustrates a more detailed construction of the housing of FIG. 2.

Referring to FIG. 2*a*, a more detailed construction of the novel housing of FIG. 2 is illustrated.

In FIG. 2*a*, the same components present in FIG. 2 are also present in FIG. 2*a*, except that the shape charge 16 is mounted into a loading tube 16*a* and electrical wires 28 from the arming, testing and firing circuit 30 are connected to terminals 24*a* via feedthru 28*a*. The loading tube 16*a* in FIG. 2*a* is one integral structure which comprises a loading tube mount 16*a*1 in which the shape charge 16 is inserted and mounted, a first longitudinal part 16*a*2 integrally connected to the mount 16*a*1 on one side thereof, a second longitudinal part 16*a*3 integrally connected to the mount 16*a*1 on the other side thereof, and a third radial part 16*a*4 in which the first wall 20 is disposed. The third radial part 16*a*4 of the loading tube 16*a* holds the first wall 20 against the second intermediate head 12-2. The detonating cord 26 is longitudinally disposed within the chamber 18, the cord 26 being disposed beneath the the first longitudinal part 16*a*2 of the loading tube 16*a*. Note that the detonator 24 is radially disposed within the second wall 22; therefore, when the second wall 22 rotates circumferentially, the detonator 24 also rotates circumferentially with respect to the longitudinally disposed detonating cord 26. Since the cord 26 is firmly held beneath the first longitudinal part 16*a*2 of the loading tube 16*a*, circumferential rotation of the detonator 24 away from the detonating cord 26 prevents a detonation of the detonating cord 26 in the event the detonator 24 fires accidentally.

A functional description of the operation or use of the housing apparatus of FIGS. 2 and 2*a* is set forth in the following paragraph.

After the one end 12*a* of the first intermediate head 12-1 is inserted into the one end 10*a* of the carrier 10 and the other end of the second intermediate head 12-2 is inserted into the other end 10*b* of the carrier 10, a user must twist (rotate circumferentially) the first intermediate head 12-1 until the detonator 24 in second wall 22 is aligned with the detonating cord 26. A switch (to be introduced below) is located within the second switch housing 14-2, yet the arming, testing and firing circuit 30 is located within the first switch housing 14-1. When the alignment of detonator 24 with detonating cord 26 is achieved and the switch located in the second switch housing 14-2 is actuated, the arming, testing and firing circuit 30 present within internal space 14-1(a) of the first switch housing 14-1 transmits an electrical signal to detonator 24 which, when detonated, initiates the propagation of a detonation wave in detonating cord 26 thereby firing the shape charge 16. However, as will be noted below in this specification, with the switch actuated to a second switched position, the arming, testing and firing circuit 30 in the switch housing 14-1 of an adjacent, successively connected perforating apparatus continues to propagate and generate the proper electrical signals, via the second switched position of the switch, necessary to detonate the charges present within the adjacent, successively connected perforating apparatus. The first wall 20 and the second wall 22 functions to isolate the charge 16 in an isolated chamber 18. Since the second wall 22 is rotatable, when the detonator 24 has been rotated out of alignment with respect to detonating cord 26, a safe-arm system associated with the perforating apparatus of FIG. 2 has been activated.

Figure 3:
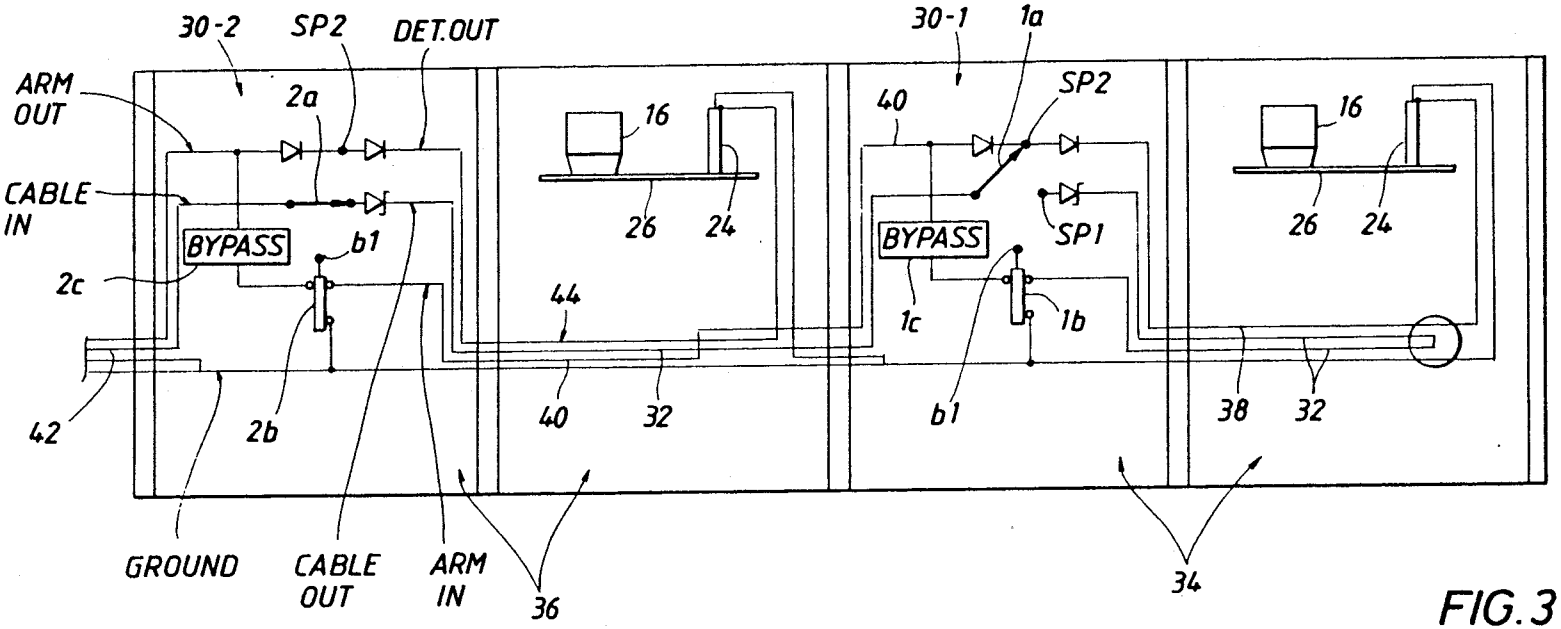
FIG. 3 illustrates a construction of the novel arming, testing and firing system housed by the perforating apparatus housing of FIG. 2.

Referring to FIG. 3, a detailed construction of the circuitry which comprises the arming, testing and firing system 30 of FIG. 2, associated with a plurality of serially connected perforating gun carriers 10, is illustrated.

Figure 3A:
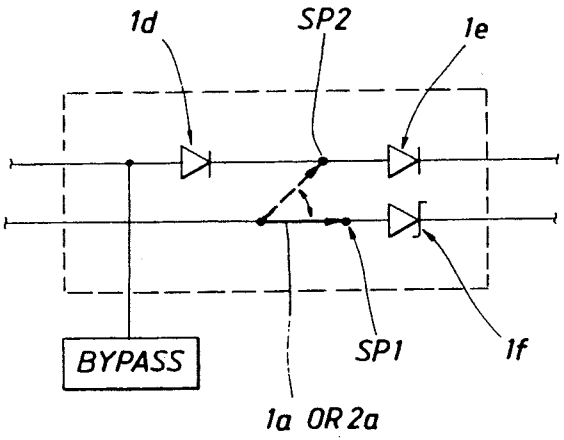
FIG. 3*a* illustrates a detail of a portion of the arming, testing and firing system of FIG. 3.

A gun string comprises a plurality of perforating gun carriers 10 serially connected together by a corresponding plurality of intermediate heads 12. The switch housing 14 disposed in each intermediate head 12 includes an arming, testing and firing circuit 30. A bottom perforating gun 34 of the perforating gun string includes a first arming, testing and firing circuit 30-1 disposed within the first switch housing 14-1 of the first intermediate head 12-1 of the bottom gun 34; the next lowermost perforating gun 36 of the perforating gun string includes a second arming, testing and firing circuit 30-2 disposed within the second switch housing 14-2 of the second intermediate head 12-2, etc. The first arming, testing and firing circuit 30-1 includes a first switch 1*a*, a first fuse 1*b*, and a first bypass circuit 1*c* in the configuration shown in FIG. 3; and the second arming, testing and firing circuit 30-2 includes a second switch 2*a*, a second fuse 2*b*, and a second bypass circuit 2*c*, also in the configuration shown in FIG. 3. Each switch (1*a* and 2*a*) has a first switched position (SPl) and a second switched position (SP2). For example, the switch la is shown in FIG. 3 as being switched to the SP2 position, whereas the switch 2*a* is shown switched to the SP1 position. Each fuse (1*b* and 2*b*) is adapted to conduct a current and includes an arm b1 which is adapted to extend from a retracted position shown in FIG. 3 to an extended position when a current of sufficient magnitude is conducted through the fuse. Each bypass circuit (1*c* and 2*c*) includes an input line input to the bypass circuit and an output line output from the bypass circuit, a bypass circuit (1*c* or 2*c*) connecting its input line to its output line when the arm b1 of its associated fuse (1*b* or 2*b*) fails to extend to the extended position in response to the passage of the current of sufficient magnitude through the associated fuse. Referring to FIG. 3*a*, the first and second arming, testing and firing circuits 30-1 and 30-2 each include a diode 1*d* and a diode 1*e* serially connected to the SP2 position of each switch 1*a* or 2*a*, and a zener diode 1*f* connected to the SP1 position of each switch 1*a* or 2*a*. When the switch 1*a* or 2*a* moves from the SP1 position to the SP2 position, the zener diode 1*f* drops out of the overall circuit; as a result, the overall voltage drop in the overall circuit is less by an amount equal to the voltage drop across the zener diode 1*f*; as a result, a user at the well surface is able to identify which perforating gun is being fired, a concept which will be described more fully in the following paragraphs.

A functional description of the first and second arming, testing and firing circuits 30-1 and 30-2 disposed in the bottom perforating gun 34 and the next lowermost perforating gun 36, respectively, is set forth in the following paragraph with reference to FIGS. 3 and 3*a*.

1. First testing the bottom gun 34 before arming

The testing function is a test to specifically identify the perforating gun, of the plurality of perforating guns in the gun string, which is about to fire. The testing is performed both before and after arming a perforating gun. The testing function, implemented before arming the bottom gun 34, is performed in the following manner: when switch la is located in the SP1 position, zener diode 1*f* in the arming, testing and firing circuit 30-1 is located within an overall circuit defined by line 32, switch 1*a*, line 32 and fuse 1*b*. Therefore, a first voltage drop of the overall circuit, when the switch la in circuit 30-1 is located in the SP1 position, is greater than a second voltage drop in the overall circuit, when the switch 1*a* in circuit 30-1 is located in the SP2 position. If a user at a well surface measures the first voltage drop of the overall circuit, the user knows that the switch 1*a* of circuit 30-1 is still in the SP1 position and therefore the bottom gun 34 is not yet armed.

2. Arming the bottom gun 34

Assuming that switch 1*a* and switch 2*a* are both located in the SP1 position, the switch 2*a* is serially connected to zener diode 1*f*, switch 1*a*, zener diode 1*f* and fuse 1*b* via line 32. When a current of sufficient magnitude is transmitted through line 32 to fuse 1*b* via switch 1*a*, switch position SP1 and zener diode 1*f* in the arming, testing and firing circuit 30-1, arm b1 of fuse 1*b* is expected to move from its retracted position to its extended position. The extension of the arm b1 of fuse 1*b* to its extended position moves switch 1*a* to the SP2 position. When switch 1*a* is moved from the SP1 position to the SP2 position, switch 2*a* is serially connected to zener diode 1*f*, switch 1*a*, diode 1*e*, and detonator 24 in the bottom gun 34. The charge 16 of the bottom gun 34 is armed and ready to fire. The arming function of the arming, testing and firing circuit 30-1 has been implemented; however, before the charge 16 is permitted to fire, a second testing function is implemented.

3. Second testing of the bottom gun 34

A further, second test of the bottom gun 34 is implemented to determine if switch la has moved to the SP2 position, the second test being performed in the following manner: note that, when switch 1*a* was in the SP1 position, zener diode 1*f* in the arming, testing and firing circuit 30-1 was present in the overall circuit including line 32; however, when switch 1*a* is moved from the SP1 position to the SP2 position, the zener diode 1*f* in the arming, testing and firing circuit 30-1 drops out of the resultant overall circuit including line 32, thus reducing the voltage drop across the overall circuit by an amount equal to the voltage drop across the zener diode 1*f*; therefore, a user at the well surface may measure a first voltage drop of the overall circuit including line 32 before transmission of the current of sufficient magnitude through fuse 1*b* and a second voltage drop in the overall circuit after transmission of the current through fuse 1*b*. The first voltage drop before transmission is higher than the second voltage drop after transmission of the current through fuse 1*b* since the zener diode 1*f* dropped out of the overall circuit after transmission of the current; therefore, the second, reduced voltage drop indicates the switch 1*a* has moved to the SP2 position in circuit 30-1 and the bottom gun 34 is about to fire.

4. Firing the bottom gun 34

After the second testing function as above described is implemented, a current of sufficient magnitude is transmitted through lines 32 and 38 via switch 1*a*, switch position SP2, and diode 1*e* to detonate the detonator 24, ignite the detonating cord 26 and fire the shape charge 16 present within the bottom gun 34.

5. Third testing of next lowermost gun 36

Now that shape charge 16 has fired, a third test is performed to determine if any other switches were actuated to the SP2 position due to shock; a second voltage drop is expected to be measured. If the second voltage drop is measured in the overall circuit, the switch 1*a* of circuit 30-1 has moved to the SP2 position, no other switches have been located in the SP2 position, and the shape charge 16 in bottom gun 34 has probably fired.

6. Arming the next lowermost gun 36

When the shape charge 16 in bottom gun 34 has been fired, switch 2*a* is located in the SP1 position, but switch 1*a* is now located in the SP2 position, and switch 2*a* is serially connected to zener diode 1*f* in circuit 30-2, to switch 1*a*, to diode 1*d* in circuit 30-1 and to fuse 2*b* via line 32 and line 40. When a current of sufficient magnitude is transmitted through lines 32 and 40 to fuse 2*b* via switch 1*a* in switch position SP2 and diode 1*d* in the arming, testing and firing circuit 30-1, arm b1 of fuse 2*b* is expected to move from its retracted position to its extended position. The extension of the arm b1 of fuse 2*b* to its extended position moves switch 2*a* to the SP2 position. When switch 2*a* is moved from the SP1 position to the SP2 position, switch 2*a* is serially connected to diode 1*e* in circuit 30-2 and to detonator 24 in the next lowermost gun 36. The charge 16 of the next lowermost gun 36 is armed and ready to fire. The arming function of the arming, testing and firing circuit 30-2 has been implemented; however, before the charge 16 of gun 36 is permitted to fire, a further fourth testing function is implemented.

7. Fourth testing of the next lowermost gun 36

The further fourth testing function is implemented in the following manner. When switch 2*a* was in the SP1 position, zener diode 1f in the arming, testing and firing circuit 30-2 was present in the overall circuit including line 32 and line 40; however, when switch 2*a* is moved from the SP1 position to the SP2 position, the zener diode 1f in the arming, testing and firing circuit 30-2 drops out of the resultant overall circuit including lines 42 and 44 thus reducing the voltage drop across the overall circuit of lines 42 and 44 by an amount equal to the voltage drop across the zener diode 1f in circuit 30-2; therefore, a user at the well surface may measure the voltage drop of the overall circuit including lines 32 and 40 before transmission of the current through fuse 2*b* and lines 42 and 44 after the transmission of the current of sufficient magnitude through fuse 2*b*; the voltage drop before transmission is higher than the voltage drop after transmission of the current through fuse 2*b* since the zener diode 1*f* of circuit 30-2 dropped out of the overall circuit after transmission of the current; the further reduced voltage drop, relative to the reduced voltage drop as described in the above paragraphs, indicates the next lowermost gun 36 is ready to fire.

8 Firing the next lowermost gun 36

After the further testing function as above described is implemented, a current of sufficient magnitude and polarity is transmitted through lines 42 and 44 via switch 2*a*, switch position SP2, and diode 1*e* of circuit 30-2 to detonate the detonator 24 in the next lowermost gun 36, ignite the detonating cord 26 and fire the shape charge 16 present within the next lowermost gun 36.

Figure 4:
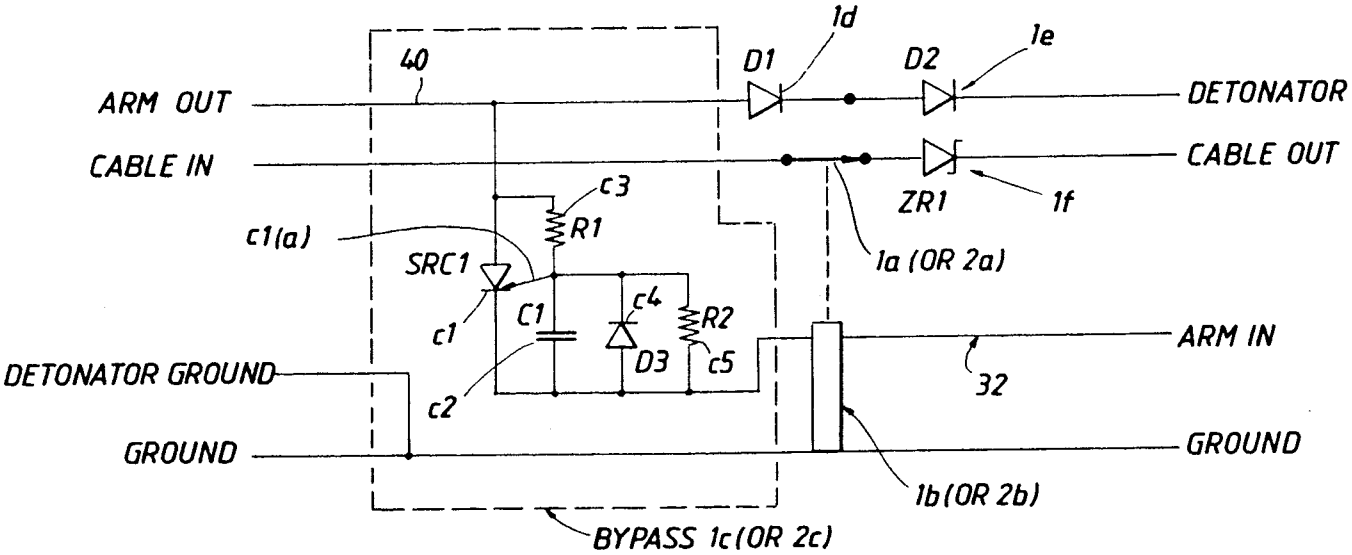
FIG. 4 illustrates a construction of a bypass circuit present in the novel arming, testing and firing system of FIG. 3.

Referring to FIG. 4, a construction of the bypass circuit 1*c* or 2*c* of FIG. 3 is illustrated.

In FIG. 4, the bypass circuit 1*c* is identical to bypass circuit 2*c*. Therefore, the description of the bypass circuit set forth below will be made relative to bypass circuit 1*c* of FIG. 3. The bypass circuit 1*c* (or 2*c*) comprises a silicon controlled rectifier (SCR) cl having a gate cl(*a*) interconnected between line 40 and line 32, a resistor (R1) c3 and a capacitor (Cl) c2 serially connected together and in parallel with the SCR c1, a diode c4 in parallel with capacitor c2 and a resistor c5 in parallel with diode c4. The SCR cl fires when a voltage of sufficient magnitude is present on its gate cl(*a*). The voltage of sufficient magnitude will be present on gate cl(*a*) when the capacitor c2 is fully charged.

In operation, referring to FIG. 4, if the fuse 1*b* fails to operate properly, in that, its arm b1 does not extend to its extended position in response to the passage of a current of sufficient magnitude therethrough which opens the fuse element, the current which normally passes through fuse 1*b* will now charge the capacitor c2. If, on the other hand, the arm bl of the fuse does in fact extend to the extended position as it should, the current in the line 32 (in) will cease to flow because of the changing of switch 1*a* or 2*a* to the SP2 position; therefore the capacitor c2 will not be charged. If the capacitor c2 charges to its fullest extent, indicating that the arm b1 of its associated fuse 1*b* did not extend to its extended position, since SCR cl is interconnected between lines 32 and 40 of FIG. 3, the voltage across the SCR cl, and in particular, the voltage on gate cl(a) of the SCR cl, will cause the SCR to conduct thereby connecting line 32 (arm-in) to line 40 (arm-out). When this happens, switch 1*a* and therefore charge 16 in bottom gun 34 is completely bypassed, and the current flowing to fuse 1*b* and SCR1 now flows through fuse 2*b*. If the arm b1 of fuse 2*b* fails to extend to its extended position properly, the bypass circuit 2*c* will connect line 32, input to the bypass circuit 2*c*, to a line 40 labelled "arm out" output from the bypass circuit 2*c*. Therefore, in this event, charge 16 of the next lowermost perforating gun 36 is bypassed and the current flowing through fuse 2*b* will now flow through the fuse associated with the next adjacent perforating gun in the gun string.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A perforating apparatus including a plurality of charges, comprising:

first means for arming a first charge of said plurality, said first means enabling the arming of a second charge of said plurality when the first charge of said plurality is armed; and second means for determining an identify of said first charge when the first charge is armed and determining an identify of said second charge when the second charge is armed.

2. A method of sequentially firing a plurality of perforators of a perforating apparatus, comprising the steps of:

testing a circuit before an arming of a first perforator of said perforating apparatus to determine a first voltage drop through said circuit;

arming said first perforator of said perforating apparatus;

testing said circuit after the arming of said first perforator to determine a second voltage drop through said circuit if said first perforator is armed;

firing said first perforator if said first perforator is armed; and bypassing said first perforator following the arming step if the first perforator is not armed.

3. The method of claim 1, further comprising the steps of:

further testing said circuit before an arming of a second perforator to determine a third voltage drop in response to the bypassing step.

4. The method of claim 3, further comprising the step of:

further arming said second perforator of the perforating apparatus in response to the further testing step.

5. The method of claim 1, further comprising the steps of:

still further testing said circuit after an arming of said second perforator to determine a fourth voltage drop in response to the further arming step; and firing said second perforator.

6. The method of claim 5, further comprising the step of:

further bypassing said second perforator following the still further testing step if the second perforator is not armed; and arming a third perforator of the perforating apparatus in response to the further bypassing step.

7. A perforating apparatus, comprising:

a carrier having a first open end and a second open end, said carrier having a surface and at least one hole disposed through said surface;

a shape charge disposed within said carrier;

loading tube means disposed within said carrier for holding said shape charge therein, said shape charge being disposed adjacent said hole in said surface of said carrier, said loading tube means including a first transversely disposed wall adapted to lie in a first cross sectional plane of said carrier;

a first intermediate head adapted to be inserted into the first open end of said carrier and disposed adjacent said first transversely disposed wall of said loading tube means; and a second intermediate head including a second transversely disposed wall connected to one end thereof which is adapted to lie in a second cross sectional plane of said carrier, said second intermediate head including the second wall being adapted to be inserted into the second open end of said carrier and adapted to rotate circumferentially within said carrier;

the first transversely disposed wall and the second transversely disposed wall defining an isolated chamber when the second intermediate head is inserted into the second open end of said carrier, said shape charge being located within said isolated chamber.

8. The perforating apparatus of claim 7, further comprising:

a detonating cord connected to said shape charge and longitudinally disposed within said isolated chamber; and a detonator radially disposed within said second transversely disposed wall, said detonator adapted to rotate into and out of alignment with respect to the longitudinally disposed detonating cord when said second intermediate head including the second wall is rotated circumferentially within said carrier, whereby the shape charge cannot detonate accidentally when the radially disposed detonator located within the second wall is rotated circumferentially out of alignment with respect to the detonating cord.

9. A perforating apparatus including a plurality of charges, comprising:

first means for arming a first charge of said plurality and enabling the arming of a second charge of said plurality when the first charge of said plurality is armed, said first means including, switch means for switching between a first switched state and a second switched state, said first charge being armed when the switch means switches to said second switched state, the arming of said second charge being enabled when the switch means switches to said second switched state; and second means for determining an identity of said first charge when the first charge is armed and determining an identity of said second charge when the second charge is armed, said second means determining the identity of the first charge when the switch means switches to said second switched state.

10. A perforating apparatus including a plurality of charges, comprising:

circuit means for arming a first charge of said plurality and enabling the arming of a second charge of said plurality when said first charge is armed, said circuit means including, switch means for switching between a first switched state and a second switched state, said first charge being armed and the arming of said second charge being enabled when the switch means switches from said first switched state to said second switched state; and housing means for housing said circuit means and said charges, 11. The perforating apparatus of claim 10, wherein said circuit means further comprises:

bypass means for bypassing said switch means and said first charge when said switch means fails to switch from said first switched state to said second switched state.

12. The perforating apparatus of claim 11, wherein said circuit means further comprises:

a circuit element connected to said switch means when said switch means is switched to said first switched state, the circuit element not being connected to said switch means when said switch means is switched to said second switched state, a first voltage drop existing across said circuit means including said circuit element when said switch means is switched to said first switched state, a second voltage drop existing across said circuit means excluding said circuit element when said switch means is switched to said second switched state, said second voltage drop being different than said first voltage drop, a difference between said first voltage drop and said second voltage drop indicating said first charge is armed.

13. The perforating apparatus of claim 10, wherein said housing means comprises:

a first wall and a second wall defining an isolated chamber, a detonating cord being longitudinally disposed within the isolated chamber, the first charge being disposed adjacent said first wall and at one end of the detonating cord within said isolated chamber.

14. The perforating apparatus of claim 13, wherein said second wall of said housing means is circumferentially rotatable and includes a radially disposed cavity, and wherein said housing means includes a detonator disposed within said radially disposed cavity of said second wall, one end of said detonator being disposed directly adjacent the other end of said detonating cord when said second wall is circumferentially rotated to a particular angular position.

15. A perforating apparatus, comprising:

a plurality of perforators including a first perforator inclusive of a first charge and a second perforator connected to said first perforator inclusive of a second charge, the first perforator including:

circuit means connected to said first charge and to said second charge in said second perforator and initially disposed in a first condition for subsequently changing from said first condition to a second condition, a first voltage drop existing across said circuit means when said circuit means is disposed in said first condition, a second voltage drop existing across said circuit means, said first charge is armed, and the arming of said second charge in said second perforator is enabled when said circuit means is disposed in said second condition; and housing means for enclosing the first charge and said circuit means.

16. The perforating apparatus of claim 15, wherein said housing means further comprises:

a carrier, said carrier including a first wall and a second wall thereby defining an isolated chamber, said first charge being disposed within said isolated chamber;

a head assembly connected to each end of said carrier; and a switch housing disposed within each said head assembly, one of the switch housings including said circuit means.

17. The perforating apparatus of claim 16, wherein said isolated chamber includes a detonating cord disposed longitudinally along an axis thereof, said second wall including a a radially disposed cavity, a detonator being disposed in said radially disposed cavity, said second wall being rotatable circumferentially, said first charge being disposed adjacent one end of said detonating cord within said isolated chamber, one end of said detonator within said radially disposed cavity being disposed adjacent the other end of said detonating cord within said isolated chamber when said second wall is circumferentially rotated to a particular angular position.

18. The perforating apparatus of claim 15, wherein said circuit means comprises a switch means for switching from a first switched state to a second switched state thereby arming said first charge in said first perforator and enabling the arming of said second charge in said second perforator, the circuit means being disposed in said first condition when the switch means is switched to said first switched state, the circuit means being disposed in said second condition when the switch means is switched to said second switched state.

19. The perforating apparatus of claim 18, wherein each circuit means comprises bypass means for bypassing said switch means and said first charge in said first perforator when said switch means fails to switch from said first switched state to said second switched state thereby failing to arm said first charge in said first perforator and failing to enable the arming of said second charge in said second perforator.

20. The perforating apparatus of claim 19, wherein:

said plurality of perforators include a third perforator connected to said second perforator inclusive of a third charge; and said second charge in said second perforator is armed and the arming of said third charge in said third perforator is enabled when said switch means switches to said second switched state thereby arming and detonating said first charge or when said bypass means bypasses said switch means and said first charge.

* * * * *